US009587357B1

(12) United States Patent
Alhalawani

(10) Patent No.: US 9,587,357 B1
(45) Date of Patent: Mar. 7, 2017

(54) CAP FOR RESTORED ASPHALT CORE AND METHODS OF PROTECTING ASPHALT CORE HOLE

(71) Applicant: Ahmad K. Alhalawani, Piscataway, NJ (US)

(72) Inventor: Ahmad K. Alhalawani, Piscataway, NJ (US)

( * ) Notice: Subject to any disclaimer, the term of this patent is extended or adjusted under 35 U.S.C. 154(b) by 0 days.

(21) Appl. No.: 14/836,951

(22) Filed: Aug. 26, 2015

(51) Int. Cl.
*E01C 11/00* (2006.01)

(52) U.S. Cl.
CPC ..... *E01C 11/005* (2013.01)

(58) Field of Classification Search
CPC ..... E01C 11/005
USPC ..... 404/9, 12–16, 75
See application file for complete search history.

(56) References Cited

U.S. PATENT DOCUMENTS

| | | | | | |
|---|---|---|---|---|---|
| 2,260,498 | A * | 10/1941 | Wise | E01F 9/553 | 404/16 |
| 2,635,513 | A * | 4/1953 | Batterson | E01F 9/553 | 404/15 |
| 3,396,639 | A * | 8/1968 | Lemelson | B60Q 1/30 | 293/117 |
| 4,127,346 | A * | 11/1978 | Bouffard | E01F 9/553 | 404/15 |
| 4,302,125 | A * | 11/1981 | Cullen, Jr. | E01F 9/553 | 404/15 |
| 5,035,531 | A * | 7/1991 | Sanchez | G09F 3/00 | 404/12 |
| 5,593,156 | A * | 1/1997 | Jambor | A63B 57/00 | 40/217 |
| 2006/0039751 | A1* | 2/2006 | Mecham | E01F 9/578 | 404/12 |
| 2006/0093432 | A1* | 5/2006 | Burlando | E01F 9/40 | 404/9 |

* cited by examiner

*Primary Examiner* — Raymond W Addie
(74) *Attorney, Agent, or Firm* — Changi Wu Law Office; Changi Wu

(57) ABSTRACT

A cap device to protect a restored asphalt core hole created from asphalt core test and methods to protect an asphalt core hole.

9 Claims, 4 Drawing Sheets

CAP FOR RESTORED ASPHALT CORE AND METHODS OF PROTECTING ASPHALT CORE HOLE

CROSS-REFERECE RELATED TO RELATED APPLICATIONS

Not Applicable.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

Pavement maintenance is the key to pavement preservation. Effective pavement preservation programs integrate many maintenance strategies and treatments, such as preventive, corrective and emergency maintenance. However, a common practice in construction, core hole testing, and often leaves newly constructed roadways vulnerable to premature damage that can inhibit effective pavement preservation. There is no doubt that asphalt pavement needs to be tested for evaluation, verification and research purposes, and that core hole testing is a cost-effective and diagnostic method by which to verify asphalt properties, as dictated by the specifications, such as thickness, structural integrity, specific gravity, air void content and percent compaction. Nonetheless, State agencies currently enforce specific procedures for asphalt core hole restoration.

BRIEF SUMMARY OF THE INVENTION

The lack of proper protection of the restored asphalt core holes leads to multiple potential asphalt failures, such as cracking, spalling, potholes, dispersion of top surface of the core hole restoration material which will result to scattering of debris throughout the roadway, disintegration of restoration material from the existing paved structure and poor physical appearance. The need of inventing a new device to improve the core sampling post-construction procedures is crucial. The inventor discerns that the current construction practice for asphalt core hole restoration does not require protection to the top surface of the restoration material and tips and edges of the existing structure resulting from core drilling, proper compaction to the restoration fill material or application of emulsifying asphaltic bonding agent. The invention of a cap device for asphalt core holes should protect asphalt core holes and the restoration material, provide better compaction for the asphalt core restoration material and provide the space for the application of a bonding agent between the core hole fill material and the existing surface. This invention provides a useful cap device to protect the restored asphalt core hole. As resolved by the inventor, a cap for protecting fill material of asphalt core hole comprises a top plate, a hollow tubular member. The tubular member is attached to the top plate, and the tubular member is substantially perpendicular to the top plate. Also, resolved by the inventor is a method to protect a asphalt core hole, which comprises the steps of placing fill materials to fulfill an asphalt core hole, forming a top of the fill material, placing a circular cap on the top of the fill material, forming a gap between the circular cap and the asphalt core hole, compacting the fill material by putting pressure on the circular cap, filing a bonding agent into the gap, leaving the circular cap in the asphalt core hole at least one day and no more than 3 days, removing the circular cap from the asphalt core hole, creating a void space from the removal of the circular cap, and filing an emulsifying bonding agent into the void space to fulfill the asphalt core hole.

DETAILED DESCRIPTION

Figure 1:
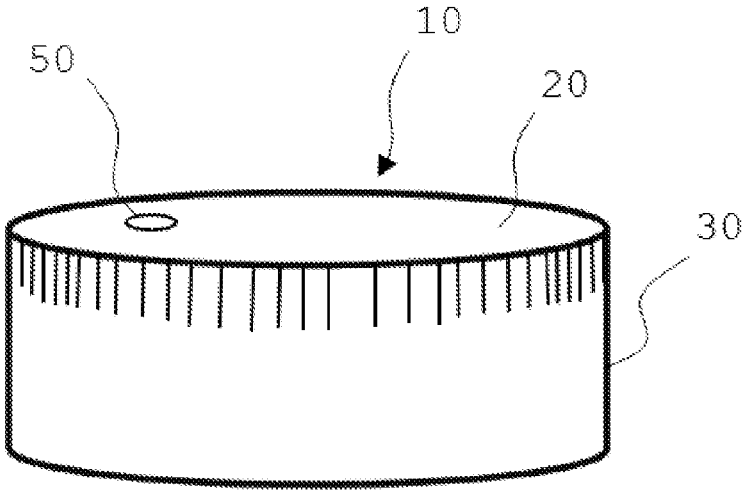
FIG. 1 is a perspective view of a cap according to some embodiments.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" include plural referents unless the context clearly dictates otherwise. Thus, for example, reference to "a plate" includes a plurality of such plates and reference to "the peripheral portion" includes reference to one or more peripheral portions, and so forth.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Referring to FIG. 1 a cap 10 has a top plate 20 and tubular member 30. Top plate 20 can be substantially circular, rectangular, or square. Tubular member 30 can be substantially circular, rectangular, or square. Cap 10 is made of material, such as cast iron, steel, high strength aluminum, high strength plastic that can sustain vehicular weight, such as 4-axle trucks, 6-axle trailer or bulldozer. Top plate 20 is attached to tubular member 30 by methods known to the person having the skill of art such as welding, screwing, bolting, adhesion, or forging ways. Top plate 20 and tubular member 30 can be different materials; however, it is also understood that even though the cap comprises two parts, top plate 20 and tubular member 30, the cap can be made with one piece such as casting or molding.

Figure 2:
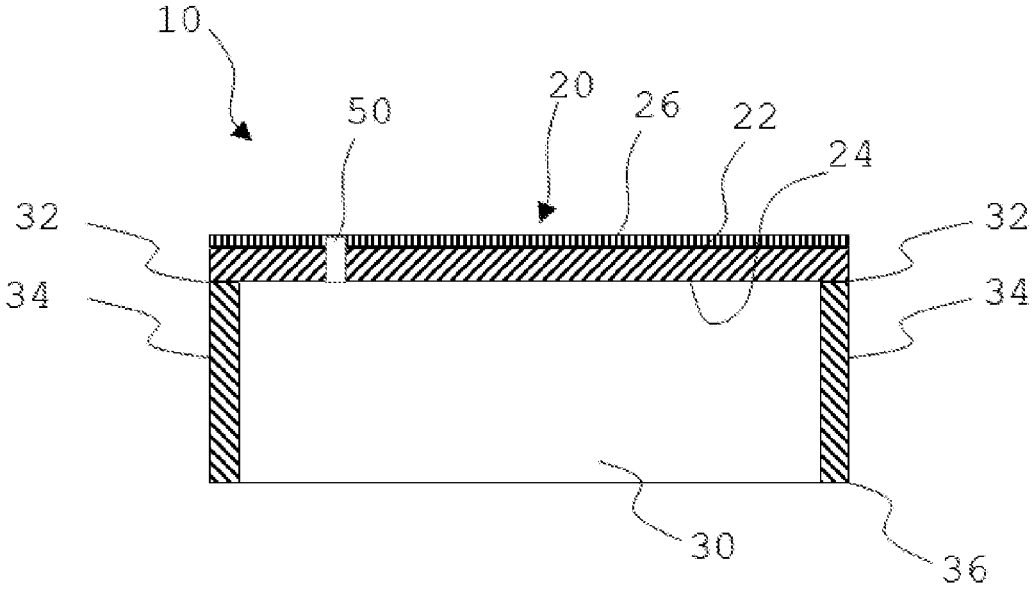
FIG. 2 is section view of a cap according to some embodiments.
Figure 3:
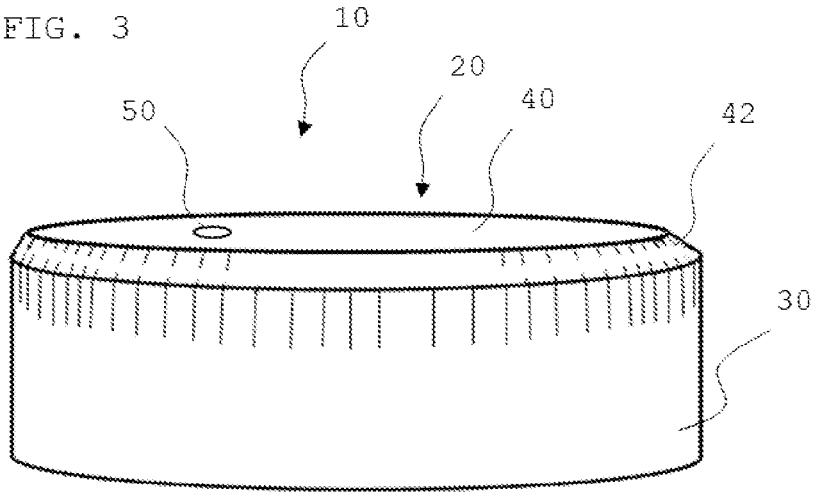
FIG. 3 is a perspective view of a cap according to some embodiments.

Referring to FIG. 2 one embodiment of a cap 10 shows a top plate 20 having an upper side 22 and bottom side 24, a tubular member 30 having a top edge 32, a tubular body 34, and bottom edge 36, where tubular body 34 is substantially axially hollow. Also referring to FIG. 2 one embodiment of a cap 10 shows that upper side 22 of top plate 20 and a opposed bottom side 24 of top plate 20, where opposed bottom side 24 is connected to top edge 32 of tubular member 30. And, tubular member 30 is substantially perpendicular to top plate 20. Also referring to FIG. 2 an optional coating material 26 is attached to upper side 22 of top plate 20. The coating material 26 can be abrasive material such as rubber, plastic, or combination of two. Also referring to FIG. 2 hole 50 is formed through top plate 20 allowing insert of tools, such as screw driver, pry bar, or steel bar, to remove cap 10 from an asphalt core hole (not shown). Referring to FIG. 3 another embodiment of cap 10, top plate 20 has a central portion 40 and peripheral portion 42. Also referring to FIG. 3 an embodiment of cap 10 has a tubular member 30.

Figure 4:
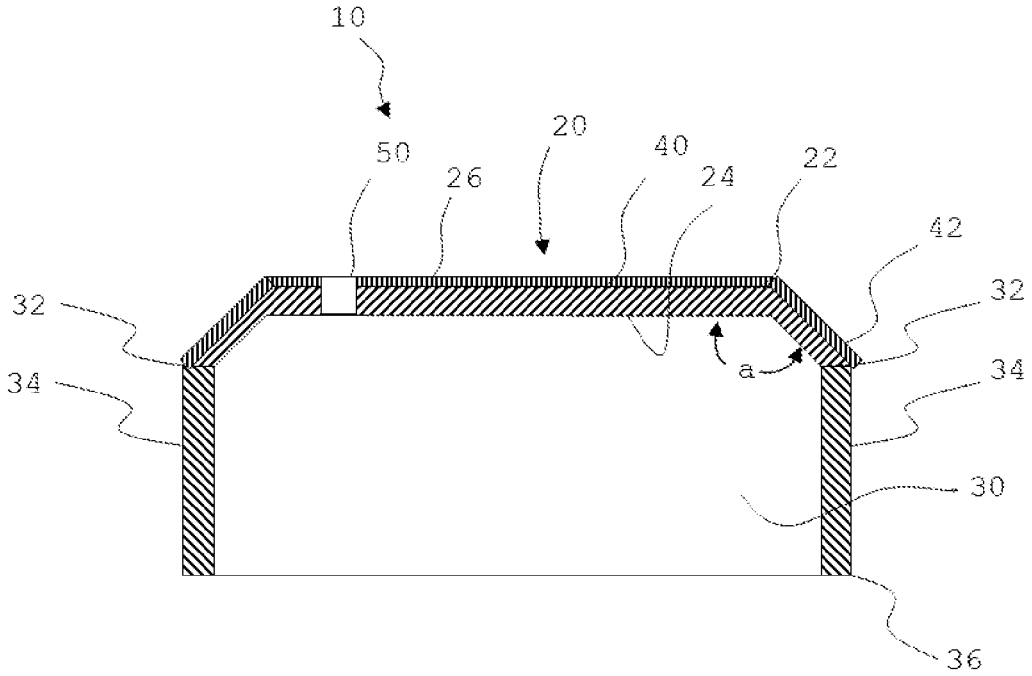
FIG. 4 is a section view of a cap according to some embodiments.

Referring to FIG. 4, an embodiment of cap 10 shows that central portion 40 and peripheral portion 42 form an angle a between 0 degree to 90 degree, and where the angle a is formed on the bottom side 24 of the top plate 20. Also referring to FIG. 2 an optional coating material 26 is attached to upper side 22 of top plate 20. The coating material 26 can be abrasive material such as rubber, plastic, or combination of two. Also referring to FIG. 4 tubular member 30 is substantially hollow where the inner diameter of tubular member 30 is approximately 5.5 inches and the outer diameter of tubular member 30 is approximately 6 inches, and where the length of the tubular member 30 is approximately 2 inches. Also referring to FIG. 4 a hole 50 is formed through the top plate 20 for allowing insert of tools, such as screw driver, pry bar, or steel bar, to remove cap 10 from an asphalt core hole (not shown).

Figure 5:
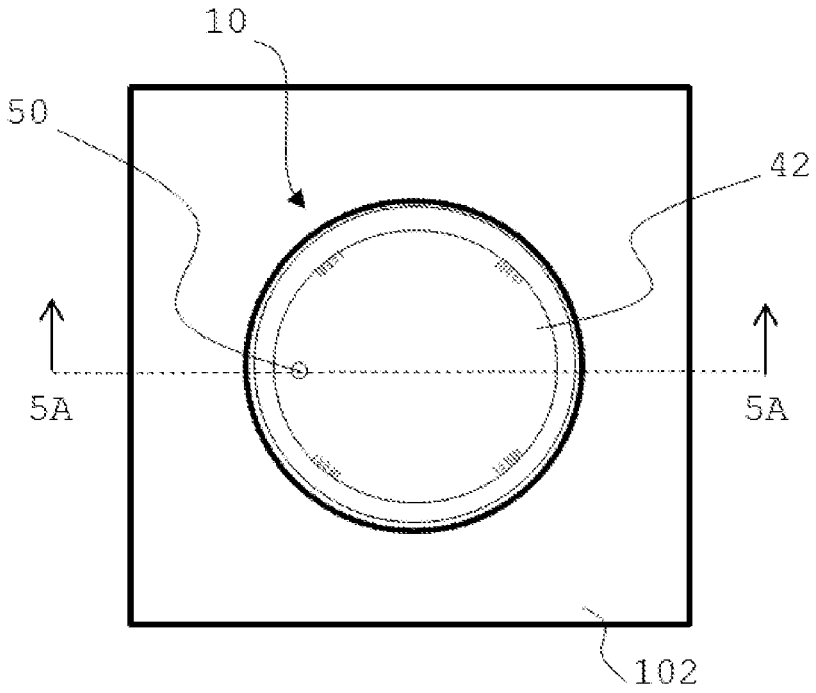
FIG. 5 is a plan view of an embodiment of the method to protect an asphalt core hole.
Figure 5A:
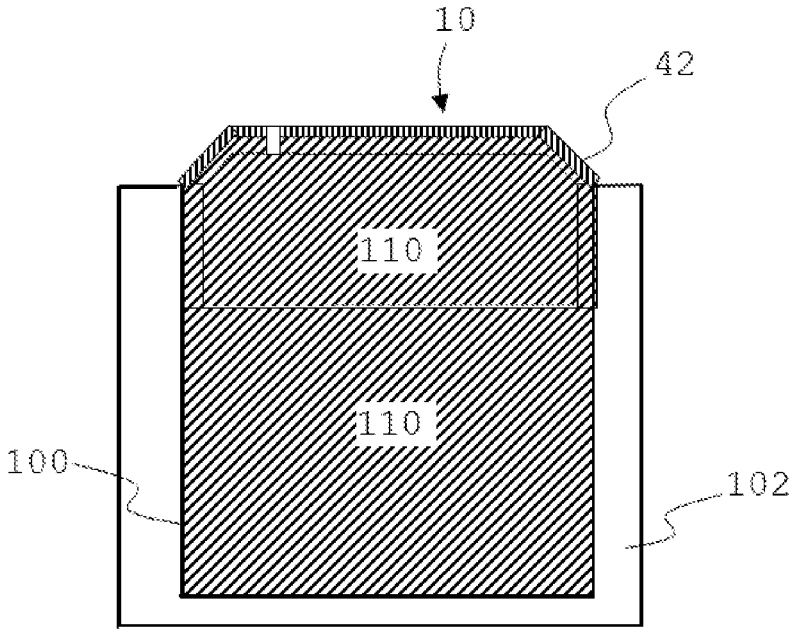
FIG. 5A is a section view of an embodiment of the method to protect an asphalt core hole.
Figure 6:
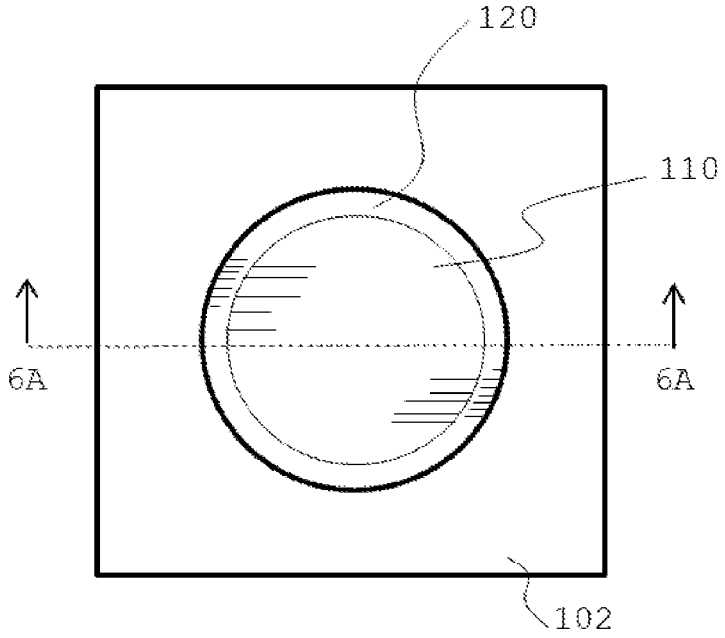
FIG. 6 is another plan view of an embodiment of the method to protect an asphalt core hole.
Figure 6A:
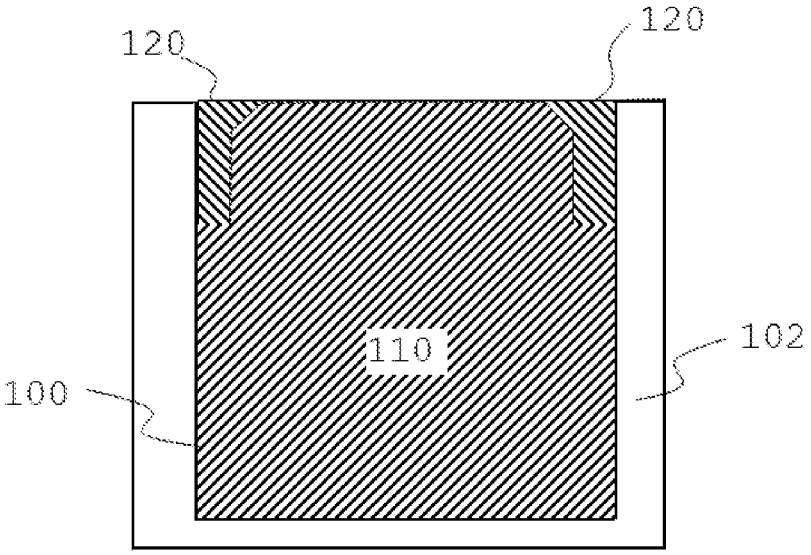
FIG. 6A is another section view of an embodiment of the method to protect an asphalt core hole.

Referring to FIGS. 5 and 5A a cap 10 is placed inside an asphalt core hole 100 formed in an existing asphalt structure 102. Referring to FIG. 5A, fill material 110 has been placed to fulfill the asphalt core hole 100, and in where cap 10 is placed on top of fill material 110. Referring to FIG. 5A fill material 110 is compacted by pressed down cap 10, and cap 10 is force into asphalt core hole 100 by hammering or other forceful way. Referring to FIGS. 6 and 6A cap 10 (not shown) is removed from asphalt core hole 100 in asphalt pavement 102. Referring to FIG. 6A emulsifying bonding agent 120 is filled between fill material 110 and the existing asphalt structure 102.

Numerous characteristics, advantages, and embodiments of the invention have been described in detail in the forgoing description with reference to the accompanying drawings. However, the above description and drawings are illustrative only. The invention is not limited to the illustrated embodiments, and all embodiments of the invention need not necessarily achieve all of the advantages or purposes, or possess all characteristics, identified herein. Various changes and modifications may be effected by one skilled in the art without departing from the scope or spirit of the invention. Although example materials and dimensions have been provided, the invention is not limited to such materials and dimensions have been provided, the invention is not limited such materials or dimensions unless specifically required by the language of a claim. The elements and uses of the above-described embodiments can be rearranged and combined in manners other than specifically described above, with any and all permutations within the scope of the inventions.

What is claimed:

1. A cap for protecting fill material of asphalt core hole, comprising a top plate having a upper side, a bottom side opposed to the upper side; and a tubular member having a top edge, a tubular body, and a bottom edge, wherein the top edge of the tubular member is attached to the bottom side of the top plate, wherein the tubular body is substantially axially hollow, wherein the tubular member is substantially perpendicular to the top plate, and wherein the tubular member is made of material that can sustain vehicular weight.

2. The cap as recited in claim 1, wherein the top plate is circular.

3. The cap as recited in claim 1, wherein the tubular member is circular.

4. The cap as recited in claim 1, further comprising a central portion and a peripheral portion, wherein the central portion and the peripheral portion forms an angle between zero degree and 90 degree, wherein the angle is formed on the bottom aide of the top plate.

5. The cap as recited in claim 1, wherein the top plate and the tubular member is substantially made of material that can sustain vehicular weight.

6. The cap as recited in claim 1, further comprising a coating material attached on the top side of the cap, wherein the coating material consists of rubber, plastic, or a combination of rubber and plastic.

7. The cap as recited in claim 1, wherein at least a hole is formed through the top plate.

8. A cap for protecting fill material of asphalt core hole, comprising a top plate having a upper side, a bottom side opposed to the upper side, wherein the top plate is made of material that can sustain vehicular weight, and wherein at least a hole is formed through the top plate, arid wherein the top plate is circular;

A central portion of the top plate and a peripheral portion of the top plate, wherein the central portion and the peripheral portion forms an angle between zero degree and 90 degree, wherein the angle is formed on the bottom side of the top plate; and a tubular member having a top edge, a tubular body, and a bottom edge, wherein the top edge of the tubular member is attached to the bottom side of the top plate, wherein the tubular body is substantially axially hollow, and the tubular member is substantially perpendicular to the top plate, wherein the tubular member is made of material that can sustain vehicular weight.

9. A method to protect an asphalt core hole, comprising the steps of

Placing fill materials to fulfill an asphalt core hole formed in an existing asphalt structure, Forming a top of the fill materials, Placing a circular cap on the top of the fill materials, Compacting the fill materials by putting pressure on the circular cap, Applying force on the circular cap until the circular cap into the asphalt core hole, Leaving the circular cap in the asphalt core hole at least one day but no more than 3 days, Removing the circular cap from the asphalt core hole, and Filing an emulsifying bonding agent between the fill material and the existing asphalt structure.

* * * * *